US006601778B2

(12) United States Patent
Hashem

(10) Patent No.: US 6,601,778 B2
(45) Date of Patent: Aug. 5, 2003

(54) CENTRIFUGAL HUMIDIFIER WITH SAWTOOTH RIDGED IMPINGEMENT SURFACE

(76) Inventor: Feisal Hashem, 41 Goldbrook Crescent, Richmond Hill, Ontario (CA), L4S 1V4

( * ) Notice: Subject to any disclaimer, the term of this patent is extended or adjusted under 35 U.S.C. 154(b) by 0 days.

(21) Appl. No.: 09/919,866

(22) Filed: Aug. 2, 2001

(65) Prior Publication Data

US 2003/0024999 A1 Feb. 6, 2003

(51) Int. Cl.[7] ..... B05B 3/02

(52) U.S. Cl. ..... 239/214.21; 239/215; 239/214.11; 239/216; 239/219; 239/222; 239/222.11; 239/223

(58) Field of Search ..... 239/214, 214.11, 239/214.17, 214.21, 215, 216, 219, 222, 222.11, 223

(56) References Cited

U.S. PATENT DOCUMENTS

| | | | | |
|---|---|---|---|---|
| 1,442,786 A | * | 1/1923 | Scheminger, Jr. | 239/214.17 |
| 1,537,650 A | | 5/1925 | Mills | |
| 1,564,949 A | | 12/1925 | Cramer | |
| 1,622,482 A | | 3/1927 | Bahnson | |
| 1,626,668 A | | 5/1927 | Cramer et al. | |
| 1,744,826 A | | 1/1930 | Cutler | |
| 1,812,356 A | | 6/1931 | Mills | |
| 1,859,770 A | * | 5/1932 | Fleisher | 159/13.4 |
| 1,864,797 A | | 6/1932 | Braemer | |
| 2,057,236 A | | 10/1936 | Hodge | |
| 2,149,921 A | | 3/1939 | Lea | |
| 2,537,833 A | | 1/1951 | Joos | |
| 2,599,202 A | | 6/1952 | Schimpke | |
| 2,631,830 A | | 3/1953 | Carraway | |
| 2,874,797 A | * | 2/1959 | Flury | 239/135 |
| 3,468,614 A | * | 9/1969 | Nilsson | 239/223 |
| 3,801,016 A | * | 4/1974 | Martin | 239/219 |
| 4,833,895 A | | 5/1989 | Johnson | |

OTHER PUBLICATIONS

Luwa Bahnson, Bahnson Centrifugal Humidifiers, Sales Brochure, 6 pages, Winston–Salem, NC, U.S.A.

Nortec Industries Inc., Defensor Centrifugal Humidifiers, Sales Brochure, 4 pages, Ogdensburg, NY, U.S.A.

* cited by examiner

*Primary Examiner*—Christopher Kim
(74) *Attorney, Agent, or Firm*—Bereskin & Parr

(57) ABSTRACT

A centrifugal humidifier having a rotatable body for propelling water outwardly on to an impingement surface that brake up the propelled water into droplets which are then entrained in a stream of air and discharged to the surroundings, wherein the impingement surface has a multiplicity of sawtooth ridges oriented with the more gradually inclined sides facing toward the direction from which the water is propelled by the rotatable body which promotes breaking up the water into finer droplets.

6 Claims, 4 Drawing Sheets

CENTRIFUGAL HUMIDIFIER WITH SAWTOOTH RIDGED IMPINGEMENT SURFACE

FIELD OF THE INVENTION

This invention relates to humidification devices, particularly centrifugal humidifiers.

BACKGROUND OF THE INVENTION

Various types of humidification devices have been developed to add moisture to dry air. In certain industrial and commercial environments, centrifugal humidifiers are often used. In such devices, water is propelled outwardly by a rapidly rotating plate or other body to impinge on a surface where it is broken up into small droplets that are entrained in a stream of air and then discharged to the surroundings.

Although the discharged air has a higher moisture content, the size of the droplets produced on the impingement surface of known centrifugal humidifiers is generally not sufficiently fine to be readily absorbed by the air. Instead, such humidifiers tend to produce a mist-like discharge. Not only does this result in a less than optimum overall humidity level, it also tends to create water build up on the surfaces of walls, equipment, furniture and so forth in the vicinity of the humidifier. More than merely an inconvenience, this promotes the growth of moulds and other microorganisms that can pose health risks to workers in the area.

Known centrifugal humidifiers are also limited in their throughput and efficiency. While increased humidification can be obtained by using larger humidifiers, or by using more humidifiers, doing so increases energy consumption and heat generation from the electric motors that are generally used to drive such centrifugal humidifiers.

Known centrifugal humidifiers also have a tendency to become clogged with dust and other particles when they are used in industrial environments such as textile mills.

It is a general object of the present invention to obviate or mitigate these and other disadvantages of known centrifugal humidifiers.

SUMMARY OF THE INVENTION

In accordance with the present invention, there is provided a centrifugal humidifier having a dish or other body rotatable on an axis for propelling supplied water outwardly by centrifugal force onto an impingement surface, generally concentric to the axis of the rotatable body, which breaks up the outwardly propelled water into fine droplets. The humidifier of the present invention also has means to intake a stream of air for entraining the fine droplets of water and thereafter to discharge the stream of air to the surroundings.

The impingement surface of the humidifier of the present invention has a multiplicity of sawtooth ridges. The ridges are each defined by a broader, more gradually inclined first side that faces toward the direction of rotation of the rotatable body, and a narrower, steeper second side that faces away from the direction of rotation of the rotatable body.

Because of the sawtooth profile, the water tends to hit and bounce repeatedly on the first sides of successive ridges which promotes breaking up the water into finer droplets that are readily absorbed by the stream of air. The centrifugal humidifier of the present invention can therefor produce a fog-like discharge, rather than the mist-like discharge of known centrifugal humidifiers. This greatly reduces the problem of wetting nearby surfaces, and also greatly increases the throughput the efficiency. The invention eliminates or reduces the need for filters or similar moisture eliminators which are commonly used in known centrifugal humidifiers to reduce wetting, but which also tend to reduce efficiency by screening out the finer water droplets as well as the larger ones. The sawtooth ridge impingement surface of the present invention also resists buildup of dust and other particles that can clog other centrifugal humidifiers.

Preferably, the centrifugal humidifier of the present invention includes a fan to take in and discharge the stream of air, and also includes a motor for driving the fan and for driving the rotatable body. Advantageously, the centrifugal humidifier of the present invention includes as well a water reservoir, and the rotatable body is generally bell shaped, with a broader flared rim and a narrower, cup-like lower portion immersed in the reservoir, such that rapid rotation of the body causes water in the reservoir to rise up the outer surface of the body to its rim from which it is propelled outwardly onto the impingement surface.

Most preferably, the centrifugal humidifier of the present invention also has a pump and conduit for delivering additional water from the reservoir to the inner surface of the rotating body.

It has been found that the centrifugal humidifier of the present invention provides an effective solution to obviate or mitigate problems presented by known prior art centrifugal humidifiers, as described above.

BRIEF DESCRIPTION OF THE DRAWINGS

For a better understanding of the present invention and to show more clearly how it may be carried into effect, reference will now be made to the accompanying drawings in which.

DETAILED DESCRIPTION OF THE INVENTION

Figure 1:
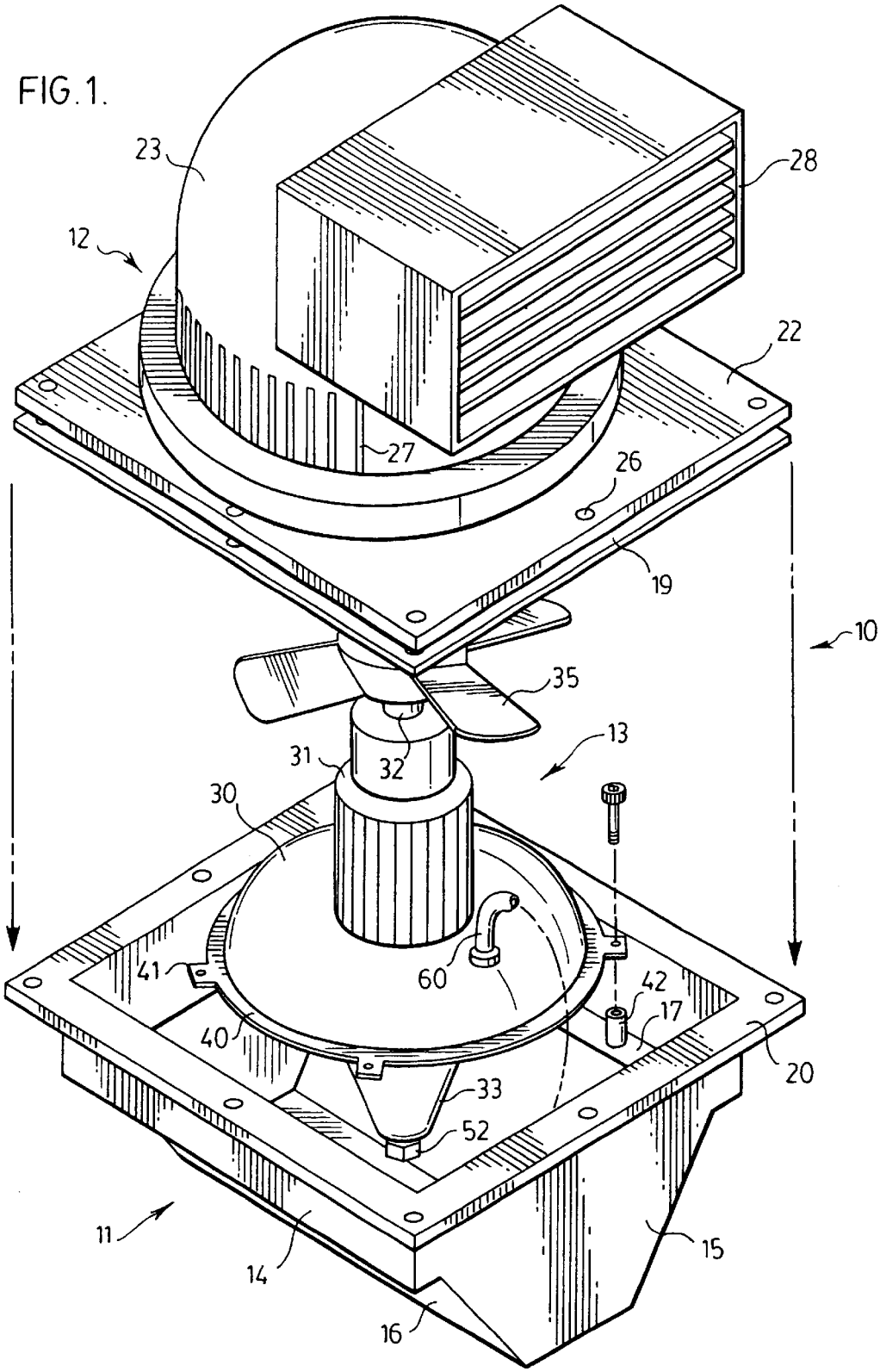
FIG. 1 is an oblique perspective view, partly exploded, of one embodiment of a centrifugal humidifier according to the present invention.
Figure 2:
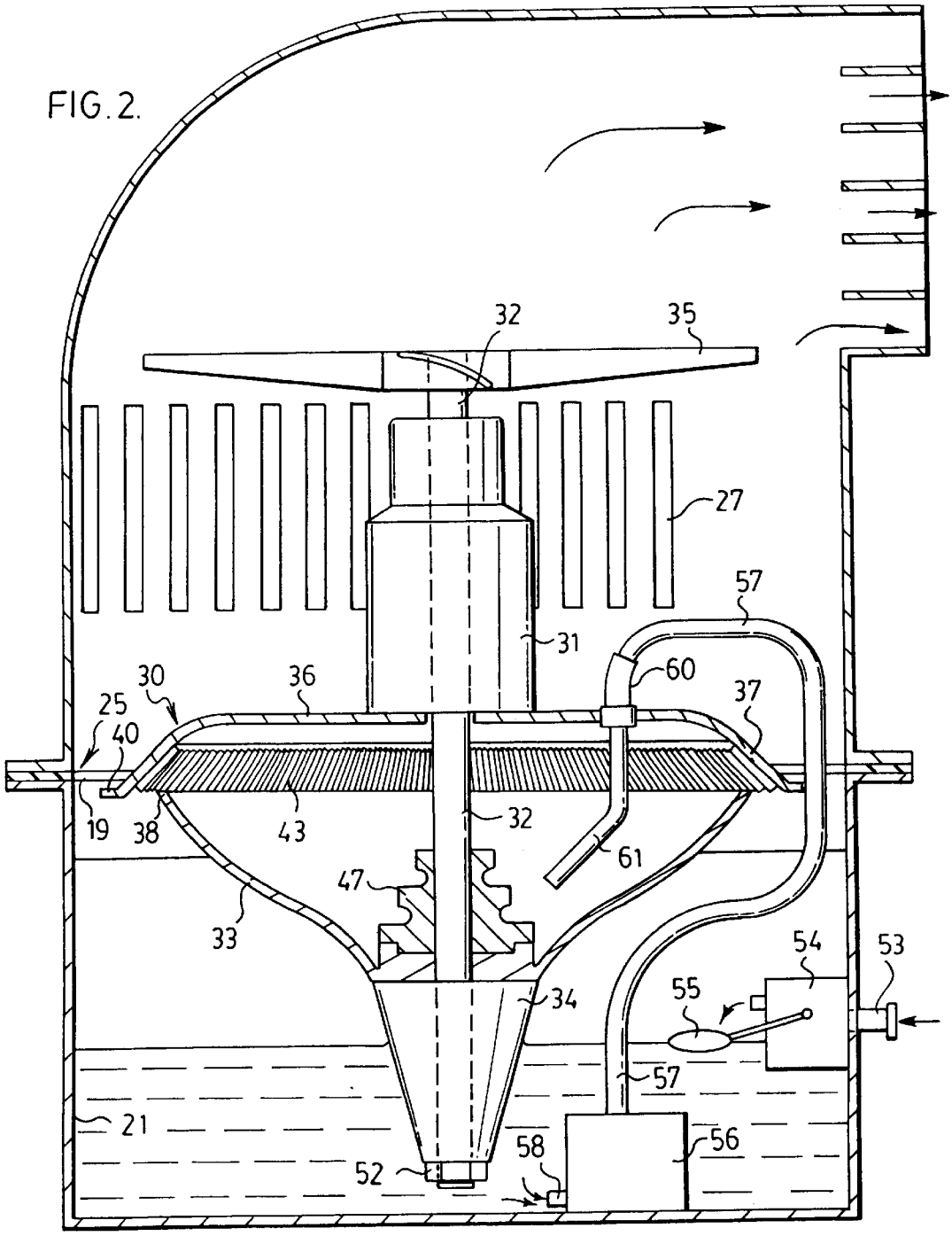
FIG. 2 is a cross-sectional view of the humidifier of FIG. 1.

Referring first to FIGS. 1 and 2, the humidifier 10 has three main sections, namely a base 11, a head 12, and a core assembly 13 positioned between the base 11 and the head 12.

The base 11 is generally box-like, and has side panels 14, end panels 15, tapered sides 16, shoulders 17, and flanges 20. The material used to construct base 11 must be able to support the core assembly 13 and the head 12, and should be rustproof since the lower inside portion of base 11 provides a water reservoir 21. A heavy gauge galvanized sheet metal can be used, wherein seams of adjoining pieces are welded. Alternatively, base 11 may be constructed of plastic using molding techniques as are known in the art.

The head 12 has a mounting plate 22, a hood 23, and an outlet duct 24 The mounting plate 22 has an opening 25 and mounting holes 26. Mounting plate 22 is sized to fit over the flanges 20 of the base 11 with a gasket 19 between them.

The hood 23 is sized to cover the opening 25 and has intake vents 27 around a portion of its periphery near its lower edge, and an outlet duct 28 on one side.

The head 12 can be made of duct material commonly known in the art, such as sheet metal, plastic or other rustproof material.

The core assembly 13 includes a cover 30, and a motor 31 having a shaft 32, on which are mounted both a composite dish and cup 33,. 34, and a fan 35.

The cover 30 has a top 36, a frustoconical sidewall 37, a lip 40 along the lower perimeter, and mounting tabs 41 which extend outwardly from lip 40. The cover 30 is sized so that it can be mounted to the shoulders 17 of the base 11 resting on the lip 40 and secured by threaded fasteners through the mounting tabs 41.

Preferably risers 42 are provided between the cover 30 and the shoulders 17. The risers 42 are comprised of threaded rods, one end of which are fastened to the shoulders 17 of the base 11 and the other end of which are fastened to the mounting tabs 41 of the cover 30. This adds space between the cover 30 and the base 11, thereby facilitating the evacuation of air and water droplets from underneath the cover 30.

The cover 30 is provided with sharp edged ridges 43 along the inner surface of the sidewall 37 which are described in greater detail below.

The motor 31 is mounted on top of the cover 30, with a vertical shaft 32 positioned coaxially with the cover 30 and extending both above and below the motor 31. Motor mounting holes 44 are provided in the top surface 36 of the cover 30, as is a shaft opening 45.

On the portion of the shaft 32 extending above the motor 31, the fan 35 is mounted. On the portion of the shaft 32 extending below the motor 31, an optional spool 47 is mounted using a stop collar or set screw or other means known in the art.

The spool 47 has three flat cylindrical elements with different outer diameters stacked together but separated by spacers of a smaller diameter. The largest cylindrical surface of the spool 47 has a diameter less than the largest diameter of the cup 34, and is positioned to face the lower end of the shaft 32.

Immediately adjacent to the spool 47 and coaxially on the shaft 32 is mounted the rotating dish 33. The axial position of the dish 33 is such that its rim 38 is aligned toward the ridges 43 of the cover 30.

The cup 34 is assembled coaxially on the shaft 32 immediately below the dish 33 and has a tapered profile that merges with the lower portion of the dish 33.

A nut 52 is provided on the shaft 32 to secure the cup 34, dish 33, and spool 47.

Connection to an external water supply is provided through a fitting 53 mounted in an end panel 15. The fitting 53 leads to a float valve 54 which is controlled by a float 55 in the water reservoir 21. When the water level in the reservoir 21 falls below a predetermined level, the float 55 causes the valve 54 to open, permitting water to flow into the reservoir 21.

In the illustrated embodiment, the water handling system includes an optional pump 56, which draws water from the reservoir 21 through an inlet 58, and supplies water through a hose 57. The hose 57 passes through an opening in the base 11, to a coupling 60 mounted in the upper surface of the cover 30. From the coupling 60, a rigid tube 61 directs the water to against the spool 47.

In operation, the motor 31 causes the fan 35 to rotate thereby creating a stream of air entering the intake vents 27 and discharged through the outlet duct 28, and also causes the dish 33 and cup 34 to spin with the shaft 32.

As the cup 34 spins, it draws water upwardly from the reservoir 21. The water moves upwardly in the form of a thin film along the outer surface 51 of the cup 34 and dish 33, until it reaches the rim 38 of the dish 33. At this point the spinning action causes the water to be thrown free of the dish 33 whereupon it strikes the ridges 43 provided on the inner surface of the cover 30.

Upon striking the ridges 43, the water is broken into very fine particles. The very fine droplets are readily entrained and absorbed into the air to provide a humidified air discharge from the head 12 that is fog-like rather than mist-like. In this sense, the discharge is "non-wetting" because objects even very close to the discharge do not become wet. The fog-like discharge becomes invisible within a relatively short distance of the outlet duct 28 in typical operation.

As the water in the reservoir 21 is depleted, the float valve 54 opens allowing supply water to flow into the reservoir 21 through the valve outlet 59. This ensures that the water level in the reservoir 21 is sufficient to keep the lower portion of the cup 34 immersed.

Figure 3:
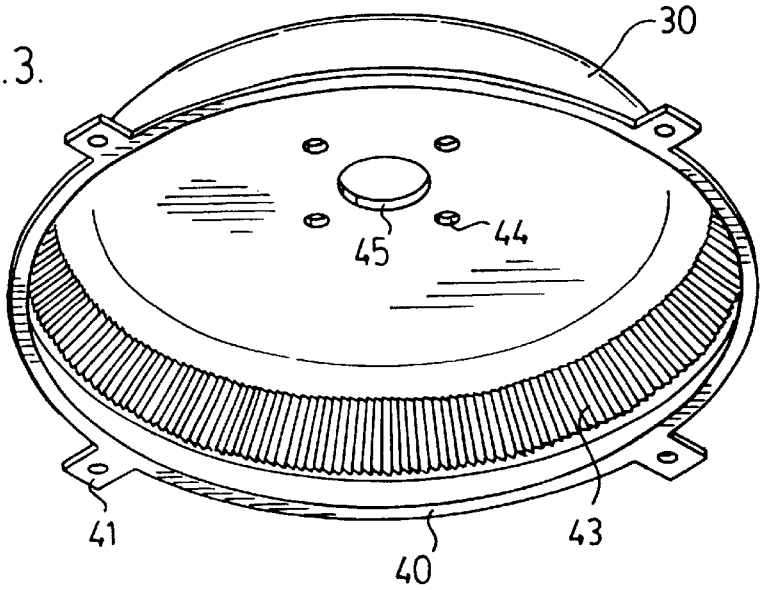
FIG. 3 is a perspective view of a component of the humidifier of FIG. 1 which includes the impingement surface.
Figure 4:
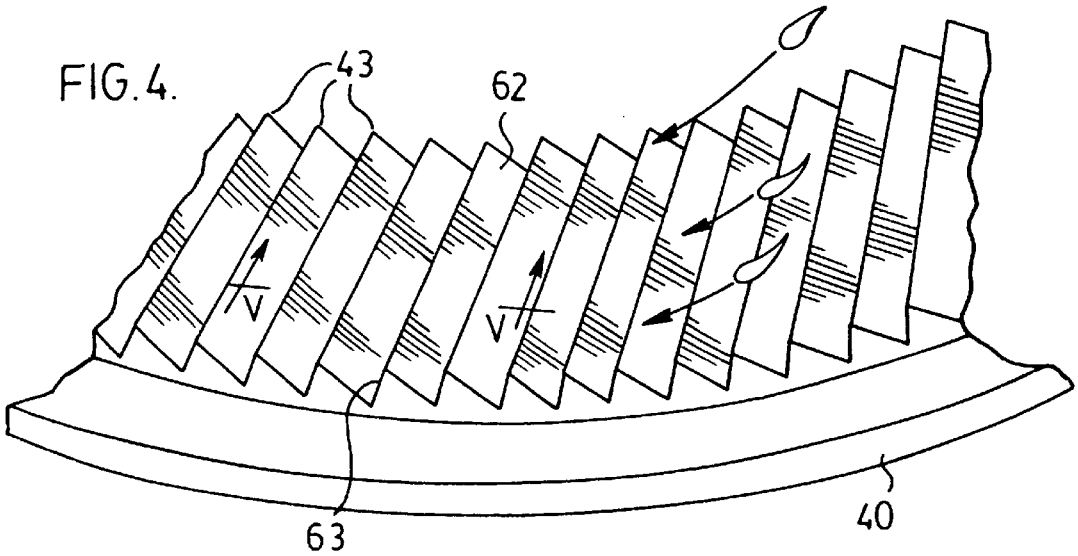
FIG. 4 is a close up view of the impingement surface on the component of FIG. 3.
Figure 5:
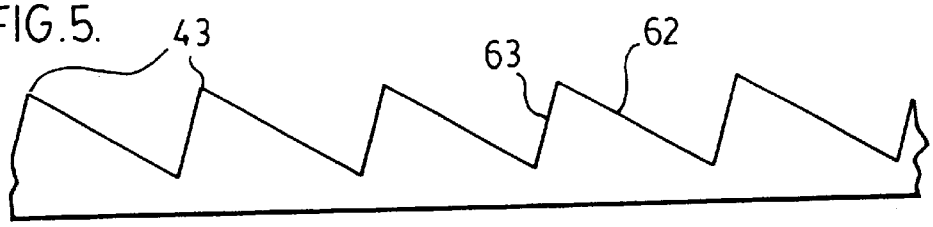
FIG. 5 is a cross-sectional view of the sawtooth ridges on the impingement surface of FIG. 4.

As shown more clearly in FIGS. 3, 4 and 5, the ridges 43 of the cover 30 provide an impingement surface that is significantly different from those of known centrifugal humidifiers. The ridges 43 present a sawtooth profile with each ridge having a broader, more gradually inclined first side 62 that faces toward the direction of rotation of the spinning dish 33, and a narrower, steeper second side 63 that faces away from the direction of rotation of the spinning dish 33.

This sawtooth profile of the ridges 43 increases the effective impact surface. Water droplets thus impinge repeatedly on successive ridges to be broken into a finer size. Moreover, less water is trapped between successive ridges so throughput and efficiency are enhanced.

The sawtooth profile is also less prone to entrapment and buildup of dust and other airborne particles.

Measurement of the droplet size in the discharge during operation of a prototype of this humidifier showed: 95 percent of the droplets between 5 to 21 microns; a minimum size of 2.2 microns; and 50 percent of the droplets under 11 microns. It was also observed that the discharge was non-wetting on human skin at a distance of 20 centimeters.

Figure 6:
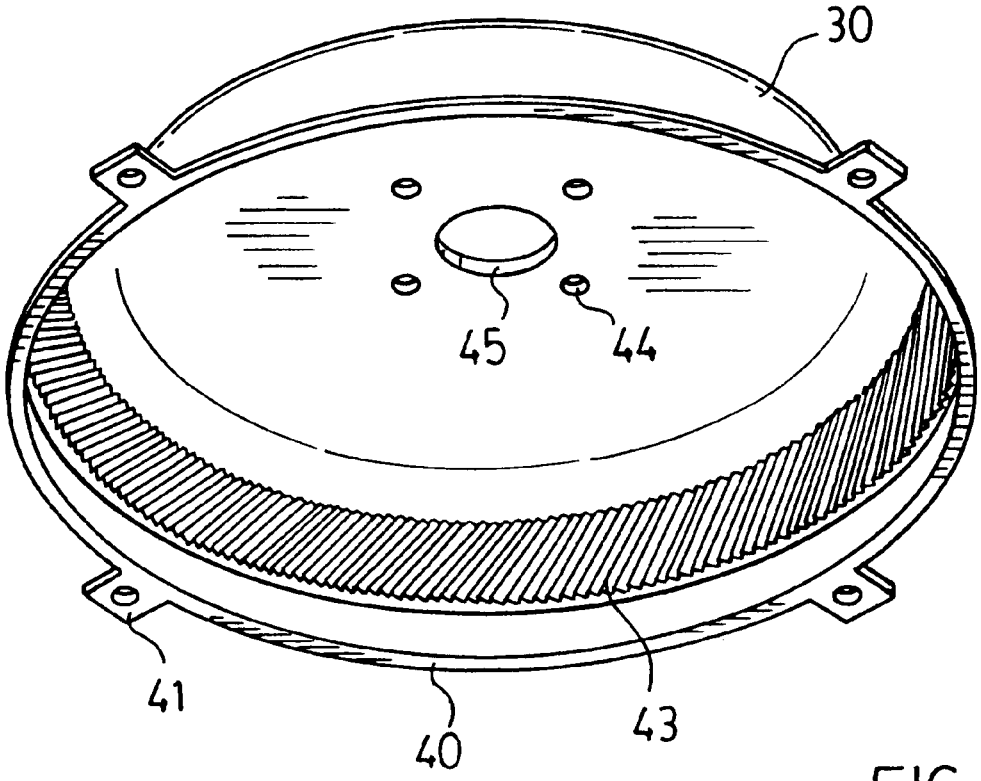
FIG. 6 is a perspective view of the impingement surface component of an alternate embodiment of a humidifier according to the present invention.

In the embodiment illustrated in FIG. 3, the sawtooth ridges are oriented radially. In an alternative embodiment shown in FIG. 6 the sawtooth ridges are spirally inclined.

The operation of the illustrated embodiment of the present invention is further enhanced by the optional pump 56. As described earlier, the pump 56 draws water from the reservoir 21 to direct a stream of water toward the spool 47 which then distributes a film of water outwardly onto the inner surface 64 of the dish 33. This water rises up the inner surface 64 until it reaches the rim 38 of the dish 33, where it is thrown free to strike the ridges 43 in the same fashion as the water drawn upwards along the outer surface 51 of the dish 33.

By using both the inner surface 64 and outer surface 51 of the dish 33 to distribute water against the ridges 43, the rate at which water is transferred to the surrounding air is increased. Use of an internal circulation pump in a prototype of this humidifier has been measured to double the performance with little effect on discharge droplet size.

Although only one tube 61 is illustrated, a plurality of tubes may also be provided to direct water at various points.

It is to be understood that the invention is not limited in its application to the details of an arrangement of components illustrated in the accompanying drawings, since the invention is capable of other embodiments and of being practiced or carried out in various ways within the scope of the claims. It is also to be understood that the terminology employed herein is intended for the purpose of description and not limitation. In its broadest scope, the present invention encompasses many modifications and alternative embodiments, appropriate for different circumstances.

What is claimed is:

1. A centrifugal humidifier, comprising:

at least one body rotatable on an axis for propelling supplied water outwardly therefrom by centrifugal force;

an impingement surface, generally concentric to said axis, for breaking up said outwardly propelled water into fine droplets;

means to intake a stream of air for entraining said fine droplets and thereafter to discharge said stream of air to the surroundings;

a rotatable shaft coupled to said body;

drive means for rotating said shaft and said body, said drive means including a motor;

a fan coupled to said drive means; and a water supply, including a reservoir;

said impingement surface having a multiplicity of saw-tooth ridges, each defined by a broader, more gradually inclined first side that faces toward the direction of rotation of said rotatable body, and a narrower, steeper second side that faces away from the direction of rotation of said rotatable body; and said rotatable body having a generally circular rim, and being bell-shaped, with a broader flared rim and a narrower lower portion immersed in said reservoir.

2. The humidifier of claim 1, wherein said impingement surface is generally frustoconical.

3. The humidifier of claim 1, wherein said water supply further comprises a pump.

4. The humidifier of claim 3 wherein said bell-shaped rotatable body has a generally concave inner surface and a generally convex outer surface, and wherein water is supplied to both said inner surface and said outer surface of said rotatable body.

5. The humidifier of claim 2 or 4 wherein said ridges are oriented radially.

6. The humidifier of claim 2 or 4 wherein said ridges are spirally inclined.

* * * * *